US008442255B2

(12) United States Patent
Akino

(10) Patent No.: US 8,442,255 B2
(45) Date of Patent: May 14, 2013

(54) BOUNDARY MICROPHONE

(75) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 354 days.

(21) Appl. No.: 12/818,204

(22) Filed: Jun. 18, 2010

(65) Prior Publication Data

US 2010/0322450 A1 Dec. 23, 2010

(30) Foreign Application Priority Data

Jun. 22, 2009 (JP) ..... 2009-148033

(51) Int. Cl.
*H04R 11/04* (2006.01)

(52) U.S. Cl.
USPC ..... 381/355; 381/87; 381/122; 381/354; 381/369

(58) Field of Classification Search ..... 381/87, 381/122, 354, 355, 369
See application file for complete search history.

(56) References Cited

U.S. PATENT DOCUMENTS

| | | | | |
|---|---|---|---|---|
| 4,565,905 | A * | 1/1986 | Nation | 381/186 |
| 6,771,785 | B2 * | 8/2004 | Pompei | 381/191 |
| 7,471,802 | B2 * | 12/2008 | Akino et al. | 381/355 |
| 7,602,931 | B2 * | 10/2009 | Akino et al. | 381/355 |
| 8,045,741 | B2 * | 10/2011 | Yoshino | 381/355 |
| 8,103,038 | B2 * | 1/2012 | Akino et al. | 381/355 |
| 8,150,087 | B2 * | 4/2012 | Akino | 381/361 |
| 8,194,908 | B2 * | 6/2012 | Akino | 381/369 |
| 8,243,975 | B2 * | 8/2012 | Akino et al. | 381/369 |
| 2005/0259842 | A1 * | 11/2005 | Akino et al. | 381/369 |
| 2006/0078148 | A1 * | 4/2006 | Akino | 381/369 |
| 2006/0078149 | A1 * | 4/2006 | Akino et al. | 381/369 |
| 2008/0159576 | A1 * | 7/2008 | Akino et al. | 381/355 |
| 2008/0159578 | A1 * | 7/2008 | Akino et al. | 381/361 |
| 2008/0232629 | A1 * | 9/2008 | Akino et al. | 381/355 |
| 2009/0034773 | A1 * | 2/2009 | Song | 381/369 |
| 2009/0097686 | A1 * | 4/2009 | Yoshino | 381/355 |
| 2009/0257613 | A1 * | 10/2009 | Khamashta et al. | 381/355 |
| 2010/0158286 | A1 * | 6/2010 | Pompei | 381/191 |
| 2010/0189301 | A1 * | 7/2010 | Akino et al. | 381/369 |
| 2010/0246876 | A1 * | 9/2010 | Akino | 381/361 |
| 2010/0303272 | A1 * | 12/2010 | Yoshino | 381/357 |
| 2010/0322450 | A1 * | 12/2010 | Akino | 381/355 |
| 2011/0019856 | A1 * | 1/2011 | Matsui | 381/355 |
| 2011/0019857 | A1 * | 1/2011 | Matsui | 381/356 |
| 2011/0058695 | A1 * | 3/2011 | Yoshino | 381/174 |
| 2011/0103623 | A1 * | 5/2011 | Shim | 381/189 |
| 2011/0170727 | A1 * | 7/2011 | Akino et al. | 381/361 |
| 2011/0182456 | A1 * | 7/2011 | Akino | 381/361 |
| 2011/0182462 | A1 * | 7/2011 | Shim | 381/393 |
| 2011/0222718 | A1 * | 9/2011 | Akino | 381/356 |
| 2012/0099752 | A1 * | 4/2012 | Akino | 381/361 |

FOREIGN PATENT DOCUMENTS

| | | | |
|---|---|---|---|
| JP | 06086394 A | * | 3/1994 |
| JP | 2007-172915 A | | 7/2007 |
| JP | 2009-100157 | | 5/2009 |

* cited by examiner

*Primary Examiner* — David S. Warren
(74) *Attorney, Agent, or Firm* — Whitham Curtis Christofferson & Cook, PC

(57) ABSTRACT

A boundary microphone includes: a metal mesh; a base made of metal; a cover made of metal on which a plurality of holes through which a sound wave is passed is formed; and a microphone unit that is installed on the base and converts sound into an electrical signal. The metal mesh is welded onto the base with a metal material of the base entering a space of the metal mesh. The microphone unit is covered by the metal mesh.

6 Claims, 5 Drawing Sheets

BOUNDARY MICROPHONE

BACKGROUND OF THE INVENTION

1. Field of the Invention

The present invention relates to a boundary microphone that is mainly placed on a desk upon use, and more specifically to a boundary microphone including a metal mesh to improve a shielding effect against electromagnetic waves.

2. Description of the Related Art

Boundary microphones are known that are mainly placed on a desk upon use. FIG. 5 illustrates an example of a conventional boundary microphone. A base 17 of the boundary microphone illustrated in FIG. 5 is formed of a flat piece of metal and can be fixed on a surface of a desk or a floor. In an upper surface of the base 17, a cavity (hollow) for mounting a circuit board 18 and the like is formed. From the upper surface of the base 17, a column 21 integrally formed with the base 17 is erected, approximately in the center when viewing the base 17 from the plane direction. A later described cover 20 is connected to the base 17 via the column 21. In the column 21, a screw hole 12 is formed from the upper end. For the base 17, the left side and the right side in FIG. 5 are the front side and the backside, respectively, and a wall is integrally formed at the back end of the base 17. A bush 19 is fitted into a hole that is formed through this wall. In the case of a boundary microphone installed in a conference room, the boundary microphone is installed on a desk or the like with the front side facing the participants. One end of a microphone cord 15 is passed through a center hole of the bush 14. The microphone cord 15 is generally a cord constituted of a two-core balanced output cord and a shielding wire wrapping around the two-core balanced output cord. The end portions of the above-described two-core signal cable and shielding wire constituting the microphone cord 15 are electrically connected to a predetermined soldering land or the like on the later-described circuit board 18.

In the upper surface of the base 17, the circuit board 18 is secured to the approximately front half portion of the above-described cavity so as to plug the cavity. In the upper surface of the circuit board 18, a microphone unit 16 is mounted with the sound wave introducing port thereof facing forward. As the microphone unit 16, a capacitor microphone unit is generally used. The cover 20 for covering the whole upper surface of the base 17 including the microphone unit 16 and the circuit board 18 is put on the base 17. The cover 20 is made of a metal material, as in the case of the base 17, and numerous openings for introducing sound waves to the microphone unit 16 are formed therein. As the material of the cover 20, generally, a punching metal is used, in which numerous holes are formed by punching. The cover 20 is press molded into a flat plate form which is then inverted and put on the upper surface of the base 17. In the cover 20, approximately in the center when viewing the cover 20 in the plane direction, a hollow is formed at a position corresponding to the column 11 of the base 17 and a hole is formed in the bottom of this hollow. A screw 13 as a fastening member is inserted into this hole, and the screw 13 is screwed into the screw hole 12 formed in the column 11, so that the cover 20 is fastened to the base 17. The head of the screw 13 sinks into the inside of the hollow of the cover 20. A receiving portion for the peripheral portion of the cover 20 is formed in the periphery of the upper surface side of the base 17, and, the receiving portion is designed so that the peripheral portion of the cover 20 can be in contact with the base 17 while the cover 20 is fastened to the base 17 with the screw 13 as described above.

As described above, the boundary microphone includes mainly two parts, i.e., the base 17 and the cover 20 in appearance, and the internal components are incorporated in the internal space. The screw 13 inserted in the hole of the cover 20 is screwed into the screw hole 22 of the base 17, and whereby the base 17 and the cover 20 are mutually fastened. The base 17 and the cover 20 are fastened together with one screw 13 approximately in the center of the cover 20 and the head of the screw 13 fits into the hollow of the cover 20.

In the internal space enclosed by the base 17 and the cover 20, electric circuits, such as an impedance converter, a tone control circuit, and an output circuit, as well as the microphone unit 16 and the circuit board 18 are incorporated. If high frequency noise composed of electromagnetic waves enters these electric circuits from the outside, this noise is detected by a semiconductor element used in the impedance converter or the like, and is then mixed into a sound signal as a noise signal, thereby degrading the signal to noise ratio (S/N) at the microphone output. Accordingly, it is preferable that the connecting portions in the peripheral portions of the base 17 and the cover 20 are joined together without any gap so as to shield the internal components from high frequency noise coming from the outside. The reason is that if these connecting portions are not joined together properly and the base 17 and the cover 20 are in point contact with each other and there is a gap therebetween, high frequency noise will enter through this gap.

Unfortunately, the conventional boundary microphone has such a structure that the base 17 and the cover 20 tend to be in point contact with each other for the reason described below. The base 17 is typically manufactured using a zinc die casting method or the like and has an uneven casting surface. On the other hand, for the cover 20, a punching metal is typically used as the material as described above, and by press molding this, the cover 20 is formed into a desired shape. However, the peripheral portion, which is electrically and mechanically in contact with the base 17, is not flat and there occur irregularities. Accordingly, if the cover 20 is directly put on the base 17 and is screwed thereinto with the screw 13, the base 20 and the cover 17 will be in point contact with each other.

The electromagnetic waves of VHF and UHF bands, which are used in the conventional TV broadcast and the like, can be shielded even if the base 17 and the cover 20 are in point contact with each other. In recent years, mobile phones using radio waves in a shorter wavelength region are widely used. There is a problem that the electromagnetic waves having a short wavelength can enter the internal space of a microphone even through a very small gap. In addition, the mobile phone is used by user's side and therefore the mobile phone is more frequently used near a microphone. Thus there is more chance of electromagnetic wave noise entering the microphone. This is true of the boundary microphone that is used in a conference room and the like.

In view of such a circumstance, Japanese Patent Application Publication No. 2009-100157 discloses an invention allowing a shielding effect to be exhibited even if a mobile phone is used near a boundary microphone. A boundary microphone according to the invention disclosed in Japanese Patent Application Publication No. 2009-100157 includes: a first metallic part disposed on one side of the upper and lower sides of internal components; and a second metallic part which is disposed on the other side of the upper and lower sides of the internal components and which encloses the internal components along with the first metallic part in all directions. A base, a cover, the first metallic part, and the second metallic part are alternately overlapped at their peripheral portions, and at least one of the first metallic part and the second metallic part is made of a metal mesh in order to pass sound waves to a microphone unit.

According to the invention disclosed in Japanese Patent Application Publication No. 2009-100157, the internal components are disposed in the space enclosed by the base and the cover and furthermore the internal components are enclosed by the base, the cover, the first metallic part, and the second metallic part whose peripheral portions are alternately overlapped. Thus, the electromagnetic waves which are to enter the internal components from the outside can be blocked more effectively. For example, even if a mobile phone is used near the microphone, it is possible to prevent the electromagnetic wave from entering the internal components and also possible to prevent the occurrence of noise caused by the electromagnetic wave. The shielding effect can be further enhanced by overlapping the peripheral portions of the first metallic part and the second metallic part with each other on the inside and outside thereof and by disposing the internal components in a space enclosed by the first metallic part and the second metallic part.

Still, there is a room for improvement for the shielding effect of the boundary microphone of the invention disclosed in Japanese Patent Application Publication No. 2009-100157 because the first metal mesh and the second metal mesh overlap with each other and a gap may be produced therebetween. The metal meshes and a boundary plate can be partially electrically connected with a screw and the like, but their connection is not continuous. Thus, there is a room for improvement for surely preventing electromagnetic waves from entering.

SUMMARY OF THE INVENTION

An object of the present invention is to provide a boundary microphone that surely prevents the entrance of electromagnetic waves by producing no gap on a shield, e.g., a metal mesh, and by continuously connecting the metal mesh with a boundary plate.

A boundary microphone according to an aspect of the present invention includes: a metal mesh; a base made of metal; a cover made of metal on which a plurality of holes through which a sound wave is passed is formed; and a microphone unit that is installed on the base and converts sound into an electrical signal. The metal mesh is welded onto the base with a metal material of the base entering a space of the metal mesh. The microphone unit is covered by the metal mesh.

With the present invention, the metal mesh and the base made of metal can be connected without any gap. Thus electromagnetic waves that are to enter the internal components from outside can be more effectively blocked. Even if a mobile phone is used extremely near the microphone, the electromagnetic wave can be prevented from entering the internal components and the occurrence of noise caused by the electromagnetic wave can also be prevented. Thus, the shielding effect can be further improved.

DETAILED DESCRIPTION OF THE PREFERRED EMBODIMENTS

An embodiment of a boundary microphone according to the present invention is described below with reference to some of the drawings.

Figure 1:
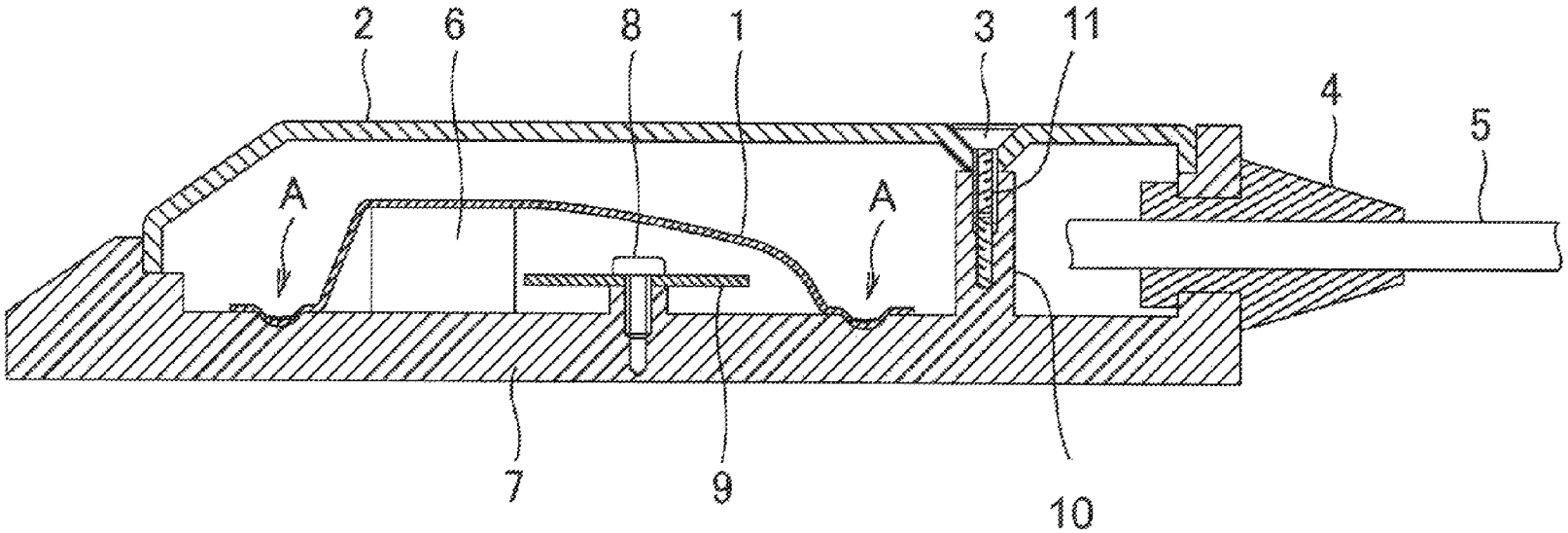
FIG. 1 is a cross-sectional view of an embodiment of a boundary microphone according to the present invention.

As illustrated in FIG. 1, this boundary microphone includes: a metal mesh 1; a microphone cover 2; a male screw 3; a cord bush 4; a microphone cord 5; a microphone unit 6; a base 7; a fixing screw 8; and a circuit board 9. The metal mesh 1 protects the microphone unit 6 from electromagnetic waves. The microphone cover 2 is made of metal, has a large number of openings (sound wave introduction holes), and is attached on the base 7. The base 7 has a flat shape with a restricted height and the upper surface side thereof is opened. The circuit board 9 is fixed with the screw 8. The microphone unit 6 may be incorporated while being installed on the circuit board 9. Alternatively, the microphone unit 6 may be incorporated separately from the circuit board 9. In an upper surface of the base 7, a hollow for mounting the circuit board 9 and the like is formed. The metal mesh 1 is welded at the approximately front half portion of the hollow of the base 7. The circuit board 9 and the microphone unit 6 are incorporated in a space formed by the base 7 and the metal mesh 1.

Figure 2:
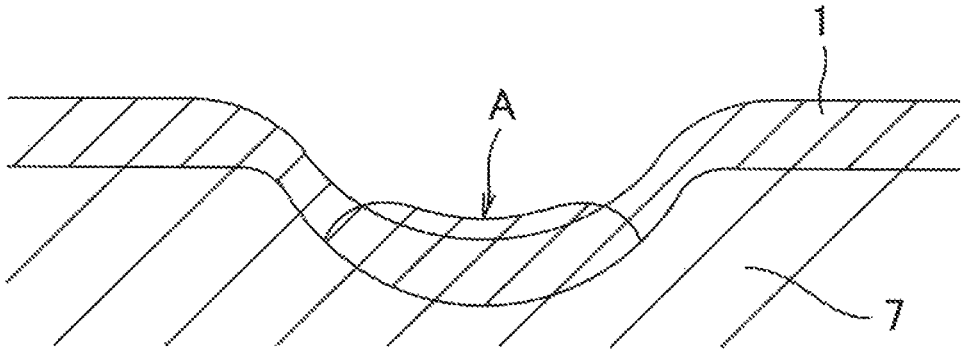
FIG. 2 is a diagram schematically illustrating a welded state of a metal mesh in the embodiment of the boundary microphone according to the present invention.

As illustrated in FIGS. 1 and 2, the microphone unit 6 and the circuit board 9 are covered with the metal mesh 1. The metal mesh 1 is welded to the base 7 with the metal material of the base 7 melted to enter the spaces of the metal mesh 1. The portion "A" in FIGS. 1 and 2 represents a welded portion of the base 7 and the metal mesh 1. As illustrated in FIG. 1, the metal mesh 1 has a convex shape lifted in the height direction. Thus, a space in which the microphone unit 6 and the circuit board 9 are incorporated can be formed between the metal mesh 1 and the base 7. The metal mesh 1 as viewed in the plane direction has the convex lifted portion shape in its center. The peripheral portion of the metal mesh 1 stays flat with no such lift to be welded onto the base 7. The metal mesh 1 can be of any shape as long as the microphone unit 6 and the circuit board 9 can be covered thereby and the metal mesh 1 can be welded to the base 7. For example, the metal mesh 1 can have a substantially rectangular planer shape or substantially circular planer shape. The convex portion lifted in the height direction can be formed to be a rectangular wave form with corners, or an arc without corners. Further, the convex lifted portion can have any planer shape, e.g., rectangular or circular, as long as the metal mesh 1 can be welded to the base 7 with the metal material of the base 7 entering the spaces of the metal mesh 1.

Figure 3:
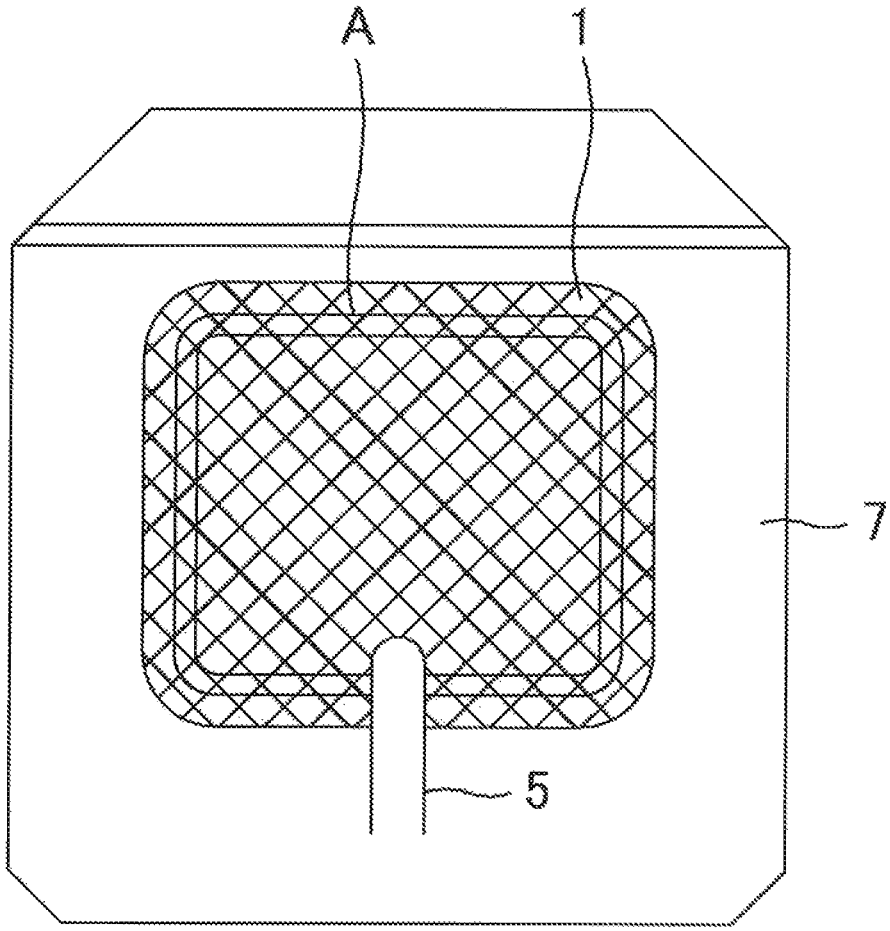
FIG. 3 is an upper view of the metal mesh in the welded state in the embodiment of the boundary microphone according to the present invention.
Figure 4:
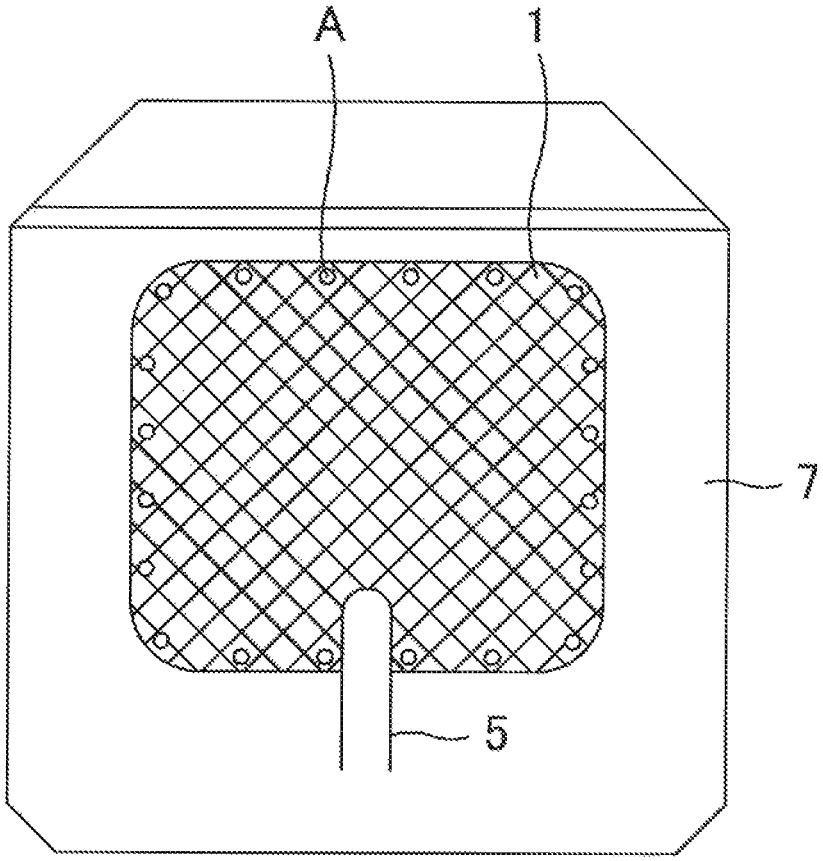
FIG. 4 is an upper view of the metal mesh in another welded state in the embodiment of the boundary microphone according to the present invention.
Figure 5:
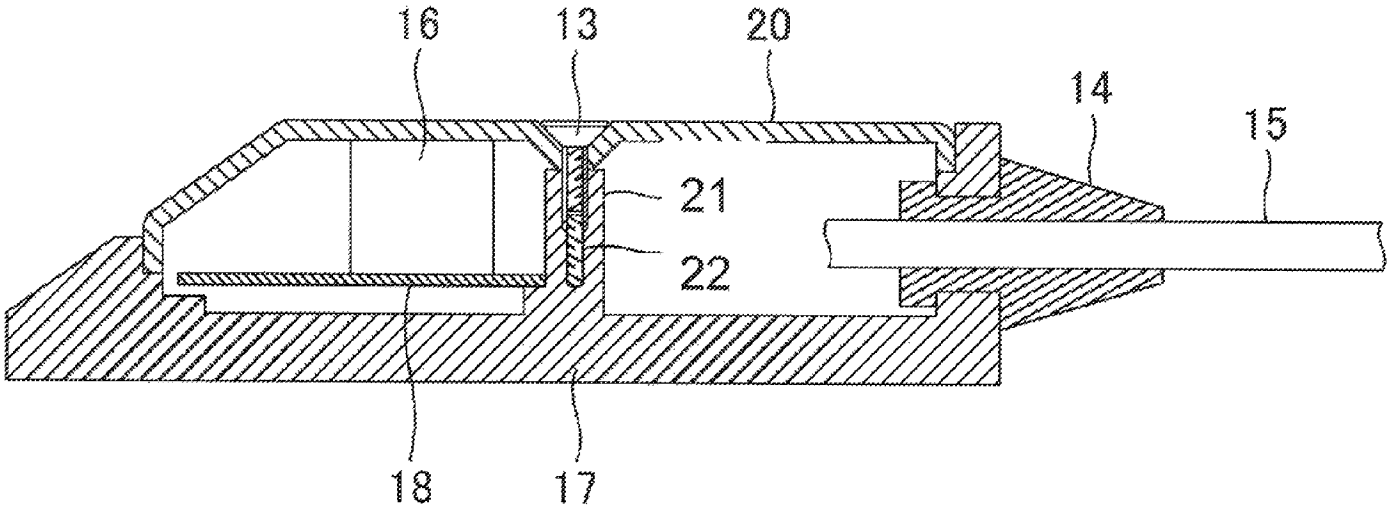
RELATED ART FIG. 5
FIG. 5 is a cross-sectional view of a conventional boundary microphone.

In FIG. 3, the whole circumference of the metal mesh 1 having a rectangular planer shape is welded. The microphone cord 5 penetrates the metal mesh 1 through a hole formed at an arbitral position without forming a gap through which electromagnetic waves enter. One end of the microphone cord 5 is connected to the circuit board 9 not illustrated. In FIG. 4, the metal mesh 1 is welded onto the base 7 at a plurality of spots provided serially with equal intervals. The metal mesh 1 and the base 7 are continuously connected by melting the material of the base 7. Here, "serially with equal intervals" means that the metal mesh 1 is welded onto the base 7 at the positions provided with equal intervals without producing any gap at the contacting position between the metal mesh 1 and the base 7. Thus, the metal mesh 1 is electrically connected to the base 7 to prevent the microphone unit 6 from being affected by electromagnetic waves. As in the structure illustrated in FIG. 3, the microphone cord 5 penetrates the metal mesh 1 through a hole provided at an arbitral position without producing any gap through which electromagnetic waves enter, and one end of the microphone cord 5 is connected to the circuit board 9 not illustrated. It is to be noted that the microphone cord 5 may enter the space formed by the metal mesh 1 and the base 7 through a space formed by lifting a portion of the periphery of the metal mesh 1 in the height direction, the portion not being welded onto the base 7. One end of the microphone cord 5 can thus be in contact with the circuit board 9 not illustrated in this way. In this case, the shape of the lifted portion preferably matches the shape of the microphone cord 5 so that no electromagnetic waves enter the space due to the lift. With the above structures, the metal mesh 1 and the base 7 made of metal can be in contact with each other without producing any gap. Thus, the electromagnetic waves which are to enter the internal components from the outside can be blocked more effectively. For example, even if a mobile phone is used near the microphone, the electromagnetic wave can be prevented from entering the internal components and the occurrence of noise caused by the electromagnetic wave can also be prevented. Thus, the shielding effect can be further improved.

The cover 2 covers the entire upper surface of the base 7 including the metal mesh 1, the microphone unit 6, and the circuit board 9. The cover 2 is made of metal like the base 7 and numerous openings are formed thereon through which sound waves are guided to the microphone unit 6. For the cover 2, a punching metal is used, in which numerous holes are formed by punching. The cover 2 is press molded into a flat plate form which is then inverted and put on the upper surface of the base 7. In the cover 2, approximately in the center when viewing the cover 2 in the plane direction, a hollow is formed at a position corresponding to a column 10 of the base 7 and a hole is formed in the bottom of this hollow. The screw 3 as a fastening member is inserted into this hole, and the screw 3 is screwed into the screw hole 11 formed in the column 10, so that the cover 2 is fastened to the base 7. The head of the screw 3 sinks into the inside of the hollow of the cover 2. A receiving portion for the peripheral portion of the cover 2 is formed in the periphery of the upper surface side of the base 7, and the receiving portion is designed so that the peripheral portion of the cover 2 can be in contact with the base 7 while the cover 2 is fastened to the base 7 with the screw 3 as described above. The shape and the material of the microphone cover 2 are not limited to those described above and can be of any shape as long as the numerous holes through which sound waves are guided to the microphone unit 6 are formed. In the embodiment described with reference to the diagrams, the base 7 and the cover 2 have substantially rectangular planer shapes. Naturally, the microphone casing composed by the base 7 and the cover 2 has a substantially rectangular planer shape. The base 7 can have any shape, e.g., rectangular or triangular, as long as it is flat in the vertical plane. If the planar shape of the base 7 is rectangular, the planer shape of the cover 2 is preferably rectangular.

In the embodiment, the metal mesh 1 is made of stainless metal. The metal mesh 1 can instead be made of any other appropriate metal materials as long as electromagnetic waves can be shielded therewith. The base 7 is manufactured by casting such as zinc die casting. The base 7 can also be a press molded material and can be made of aluminum. The base 7 is preferably made of metal with a lower melting point than that of the metal mesh 1 so that the material of the base 7 can be melted into spaces of the metal mesh 1 as illustrated in FIG. 2, easily upon welding. An example of this is a combination of the metal mesh 1 made of stainless metal and the base 7 made of zinc. Further, for the microphone cover 2, instead of a generally used punching plate (porous plate) formed of a metal plate on which numerous holes are formed, a woven wire material may be used.

A boundary microphone generally includes a capacitor microphone unit with an impedance converter as the microphone unit 6. A tone control circuit and a sound output circuit, both of which are not illustrated, are provided on the circuit board 9. One end of the microphone cord 5 is connected to the circuit board 9, while the other end extends outward from the base 7 via the cord bush 4. In the case of a wireless microphone, an antenna connected to an external line like the microphone cord 5 is provided on the microphone casing as a transmission unit. In the case of an optical wireless microphone, a light emitting diode, for example, is provided thereon.

The boundary microphone according to the present invention is not limited to the above described embodiment of the present invention. More specifically, the boundary microphone according to the present invention may be so appropriately designed that the cover 2 is fitted to the base 7. In this case, the boundary microphone can be formed without the column 10, the male screw 3, and the screw hole 11. Further, the metal mesh used in the boundary microphone according to the present invention can also be used in, for example, a microphone attached with a speaker.

What is claimed is:

1. A boundary microphone comprising:

a metal mesh;

a base made of a metal material;

a cover made of metal on which a plurality of holes is formed through which a sound wave is passed; and a microphone unit that is installed on the base and converts sound into an electrical signal, wherein the metal mesh is welded onto the base with one or more welds and with the metal material of the base entering a space of the metal mesh, and the microphone unit is covered by the metal mesh, wherein the metal material of the base has a melting point lower than that of the metal mesh.

2. The boundary microphone according to claim 1, wherein the metal mesh is electrically connected to the base.

3. The boundary microphone according to claim 1, wherein said one or more welds includes a plurality of welds of the metal mesh in a serial manner with an equal interval between welds to make the metal mesh and the base be continuously connected.

4. The boundary microphone according to claim 1, wherein said one or more welds of the metal mesh is applied to an entire periphery of the metal mesh.

5. The boundary microphone according, to claim 1, wherein the metal mesh is made of stainless metal.

6. The boundary microphone according to claim 1, wherein the metal material of the base is zinc.

* * * * *